United States Patent [19]

Bedocs et al.

[11] Patent Number: 4,975,071

[45] Date of Patent: Dec. 4, 1990

[54] TRACK LIGHTING

[75] Inventors: Lou Bedocs, Bishops Stortford, England; Michael C. Eksteen, Transvaal, South Africa

[73] Assignee: Thorn Emi plc, London, England

[21] Appl. No.: 436,948

[22] Filed: Nov. 15, 1989

Related U.S. Application Data

[63] Continuation of Ser. No. 131,690, Dec. 11, 1987.

[30] Foreign Application Priority Data

Dec. 12, 1986 [ZA] South Africa ..... 86/9383

[51] Int. Cl.[5] ..... H01R 25/02

[52] U.S. Cl. ..... 439/121

[58] Field of Search ..... 439/110, 111, 117–119, 439/121

[56] References Cited

U.S. PATENT DOCUMENTS

| | | | |
|---|---|---|---|
| 3,639,885 | 2/1972 | Yoshiya et al. | 439/118 |
| 4,108,523 | 8/1978 | Bolis | 439/121 X |
| 4,139,252 | 2/1979 | Gorny | 439/118 X |
| 4,217,018 | 8/1980 | Yoshida et al. | 439/118 |

*Primary Examiner*—Eugene F. Desmond

*Attorney, Agent, or Firm*—Fleit, Jacobson, Cohn, Price, Holman & Stern

[57] ABSTRACT

An adapter for mounting a lamp fitting on a lighting track comprises a hollow body member, a head which can be slid along the track and a pair of resilient contact strips. An electrically insulating separator maintains the contact strips in spaced apart relationship in the body member and respective pairs of grooves formed in the head hold the contact strips so that bowed sections of the contact strips press against supply rails which extend along the side walls of the track.

24 Claims, 3 Drawing Sheets

TRACK LIGHTING

This application is a continuation of application Ser. No. 07/131,690, filed Dec. 11, 1987, now abandoned.

This invention relates to track lighting systems and in particular to an adapter suitable for mounting a lamp fitting onto a lighting track and to a track lighting system incorporating such an adapter.

Low voltage track lighting systems are known with lighting tracks having externally mounted conducting rails. A major disadvantage of this is that the rails are exposed to dirt and dust and are liable to corrode.

The present invention relates to a track lighting system with a track having partially concealed supply rails which alleviates the above disadvantage. It is an object of the invention to provide an adapter which provides good electrical contact with the track.

According to the invention there is provided an adapter suitable for mounting a lamp fitting onto a lighting track, the lighting track having a top wall and two side walls defining a generally C-shaped elongate channel, each side wall supporting a respective supply rail disposed within the channel, the adapter comprising a body member having a cavity, a head which, in use, fits within and is displaceable slidably along the channel, two electrical contact members and a separator of an insulative material, the head being adapted to locate each contact member, a first portion of each member lying within said cavity and a second portion thereof extending outwardly from the head member, the separator being located within said cavity between said first portions to maintain the members in electrical isolation, each said second portion thereof being capable of resiliently contacting a respective supply rail, thereby to establish electrical contact between the supply rails and a lamp fitting which may be mounted on the body member.

According to a further aspect of the invention there is provided a low voltage track lighting system comprising a track having a top wall and two side walls defining a generally C-shaped channel, each side wall supporting a respective supply rail disposed within the channel, and an adapter as defined in the immediately preceding paragraph.

In order that the invention may be clearly understood and readily carried into effect, it will be described by way of example, with reference to the accompanying drawings, of which:

Figure 3:
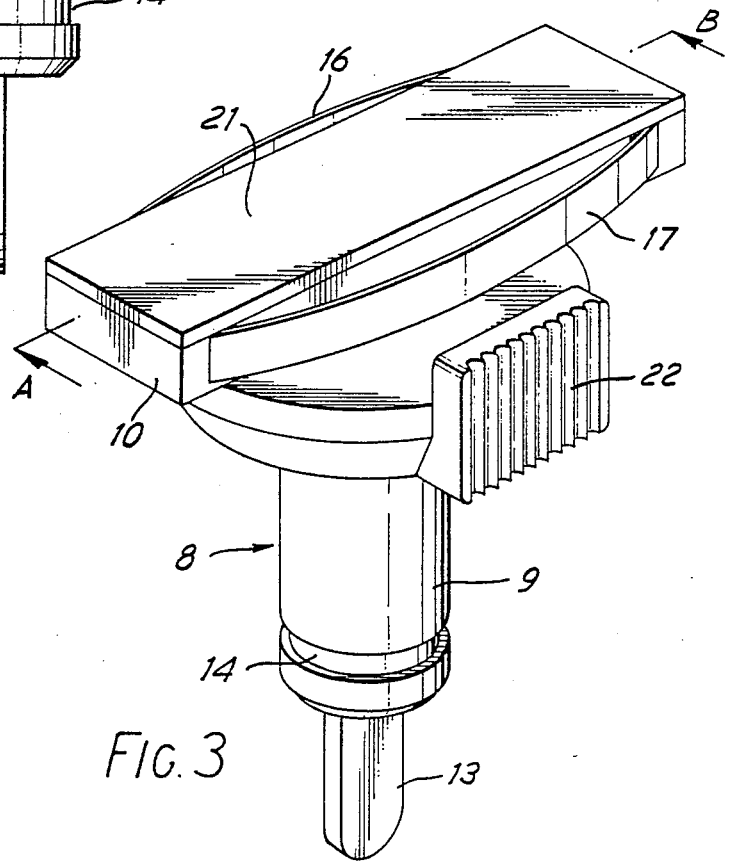
Figure 2A:
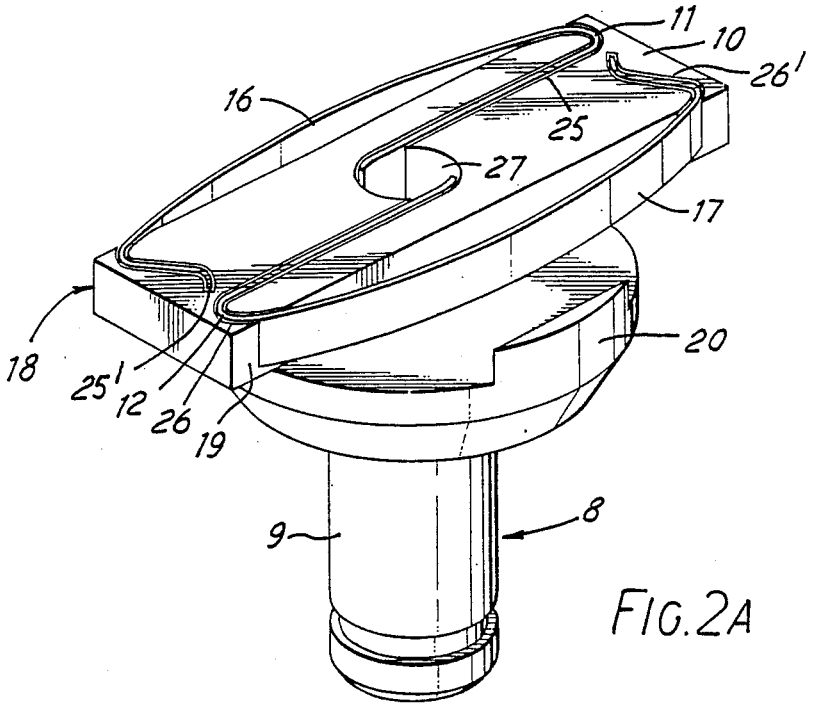
FIG. 2A is a perspective view of an adapter.
Figure 2B:
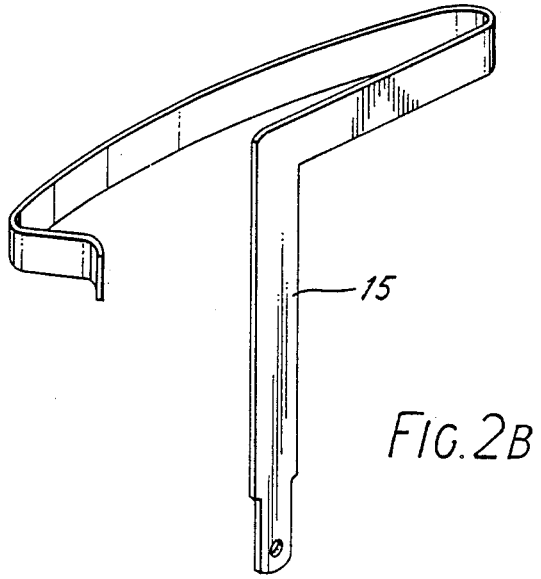

FIG. 2B an electrical contact strip for use in such an adapter,

FIG. 3 shows a perspective view of the adapter with a cover attached.

Figure 5:
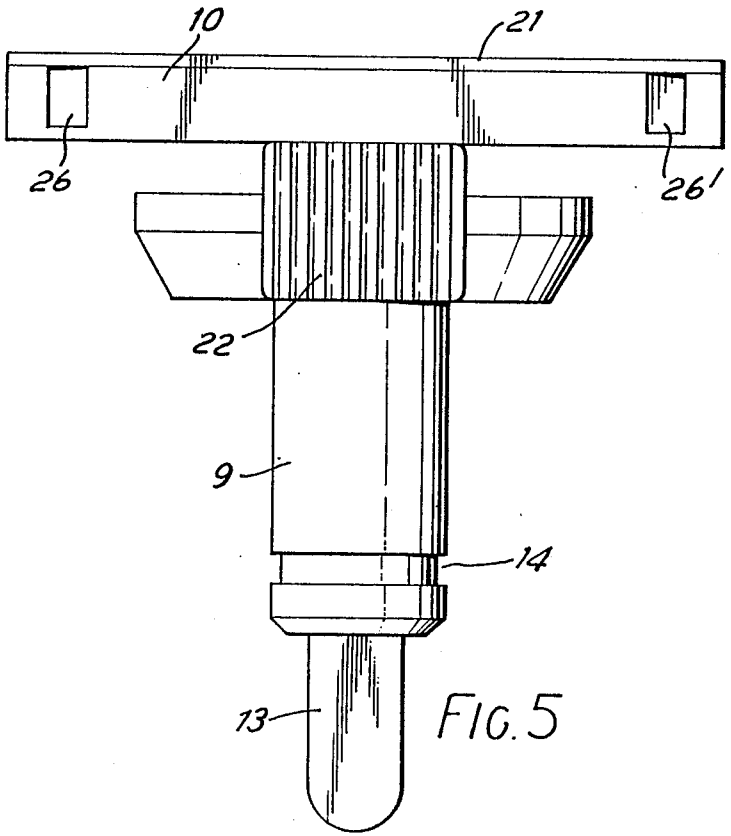
Figure 4:
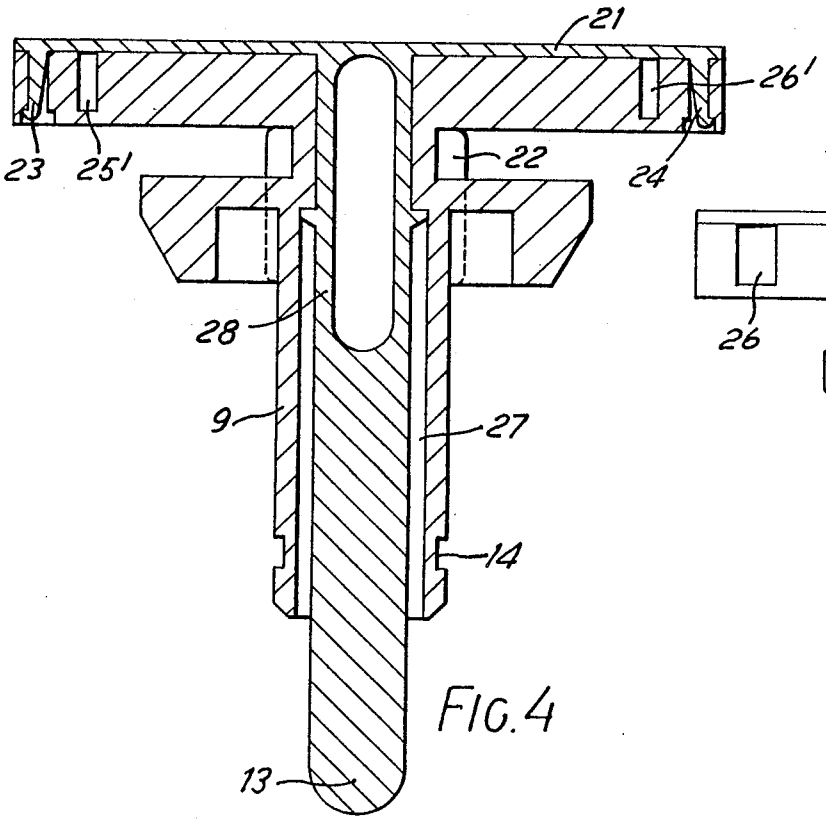

FIG. 4 is a longitudinal cross sectional view of the adapter taken on line AB of FIG. 3 looking in the direction of the arrows, and FIG. 5 is a side elevational view of the adapter of FIG. 4.

Figure 1:
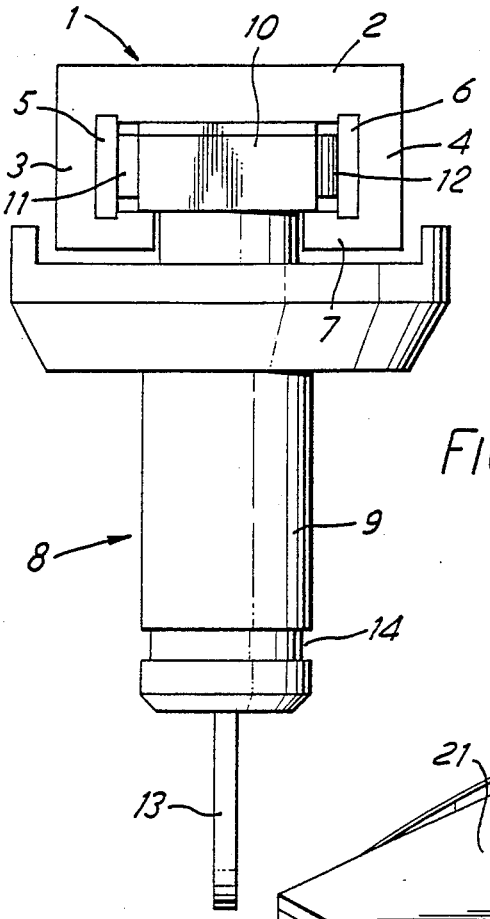
FIG. 1 shows an end-on view of a lighting track and an adapter invention.

Referring first to FIG. 1, this shows a lighting track 1 having a top wall 2, two side walls 3, 4 and a slotted lower wall 27 defining a generally enclosed C-shaped channel. Each side wall supports a respective supply rail 5, 6. The supply rails are internal to the channel and do not pick up as much dust and dirt as external conductors. The track may desirably be of polycarbonate. The adapter 8 for mounting a lamp fitting onto the track consists of a body member 9 and a head 10. The head fits within the channel and is displaceable slidably along it. The channel is elongate and may be linear, but it will be understood that with an adapter according to the invention other configurations of track are possible, provided that the supply rails are substantially parallel with each other.

The head is adapted to locate two electrical contact strips 11, 12 which can be seen more clearly in FIGS. 2A and 2B. In the embodiment shown, the body member has a groove 14 at its lower end for cooperation with a ledge in the stalk of a lamp fitting which can be mounted on it, but any other suitable mounting means may be used.

FIG. 2A shows more clearly the structure of the adapter, and FIG. 2B an electrical contact strip. In this particular example each contact strip has a one-piece construction, though alternative constructions comprising an assembly of suitably connected parts could be used.

In the embodiment shown, each contact strip is located by a respective pair of grooves 25, 25' and 26, 26', such that a first portion 15 of each contact strip lies within the body cavity, and a second portion thereof 16, 17 extends outwardly from the head member. A separator 13 (not shown in FIG. 2A) of an insulative material, when inserted within a cavity 27 of the body member, is wedged between the contact strips maintaining them in electrical isolation from one another and holding them firmly in position. When the head is located within the channel, the second portions of the contact strips which are resilient and, in the embodiment shown, are of a bowed form, are compressed onto the supply rails of the track, each engaging resiliently with a respective supply rail. This ensures good electrical contact between the strips and the supply rail and establishes electrical contact between the supply rails and a lamp fitting mounted on the body member. Nickel plating of the electrical contact strips reduces friction between the strips and supply rails.

An advantage of the contact strips being bowed springs as in this embodiment, or of similar form with the ends returning towards, or re-entrant into, the head, is that the adapter can be slid in either direction along the track.

If the head is substantially rectangular with faces 18, 19 parallel to the side walls of the track when in use, this aids the positioning of the adapter relative to the track and prevents rotational motion of the adapter. Guide means, such as upstanding members 20 integral with the adapter body which, in use, protrude past the track, may also be included to aid positioning of the adapter.

FIG. 3 shows the adapter of FIG. 2A, having a top cover 21 fitted, which is desirable to give a neat appearance to the adapter and helps to hold the construction together. In this case, the cover is integral with the separator 13, as can be seen more clearly in FIG. 4.

FIG. 3 also shows a guide 22, which, rather than having a curved external surface as do guides 20 of FIG. 2A, has a knurled surface which provides thumb grips useful for positioning the adapter on the track.

A further advantage of the present invention is its simple construction. Compared with some known constructions relatively few components are used and assembly is straightforward.

FIG. 4 is a cross-sectional side elevation of an adapter substantially as shown in FIG. 3, having a cover 21 integral with the separator and clipped in place on the head at 23, 24. The adaptor is constructed by first locating the bowed portions of the conducting strips in the grooves 25, 25' and 26, 26' in the head, with substantially straight portions 15 extending downwardly into the cavity 27 in the body. (Portions 15 are not visible in FIG. 4.) The separator is then placed in position with portion 28 between the portions 15 of the two contact strips in the cavity and holds the conducting strips in position enabling them to be readily connected to a light fitting, and the cover 21 is clipped into place over the head. There are only therefore four basic parts to the adaptor - the adaptor body and head (one piece), the two conducting strips and the separator. The separator may of course be of other forms and need not have an integral cover. The cover itself is optional.

FIG. 5 is a side elevation of the adaptor shown in FIG. 4. The ends of the grooves for locating the contact strips are visible, but the contact strips are not in place.

The invention is particularly directed to low voltage track lighting systems. With low voltage, high current systems there may be a problem with arcing which is alleviated by a separator of the kind described herein.

Also, because of the greater efficiency of electrical contact, the spring contact pressure can be reduced compared with that of known track systems and a high contact pressure, produced for example by mechanical advantage, is not required.

We claim:

1. An adapter suitable for mounting a low voltage lamp fitting onto a lighting track, the lighting track comprising a housing of an insulative material, the housing having a top wall and two side walls defining a generally C-shaped elongate channel, each side wall carrying an inwardly directed flange, each side wall supporting a respective supply rail disposed within the channel, the adapter comprising a body member having a cavity, a substantially rectangular head which, in use, is an end fit within and is displaceable slidably and non-rotationally along the channel the flanges thus supporting the adapter together with any lamp fitting mounted on the adapter, two electrical contact members and a separator of an insulative material, the rectangular head comprising two long sides and two short sides, the long sides being adapted to located each contact member, a first portion of each member lying within said cavity and a second elongate portion thereof extending outwardly from the head member such that it lies along the long side of the rectangular head, the separator being located within said cavity between said first portions to maintain the members in electrical isolation, each said second portion thereof being capable of resiliently contacting a respective supply rail, the dimensions of the head and second portions together relative to those of the channel and the resilience of the second portions being so as to locate the head within the channel and establish substantially constant pressure electrical contact between the supply rails and the second portions over a substantial part of the second portions so as to provide electrical power to a lamp fitting supported by the lighting track.

2. An adapter according to claim 1 in which the electrical contact members include bowed springs.

3. An adapter according to claim 1 in which the electrical contact members are nickel plated.

4. An adapter according to claim 1 each electrical contact member has a one-piece construction.

5. An adapter according to claim 1 in which the separator has a top cover integral with it.

6. An adapter according to claim 1 in which the head comprises grooves for locating the contact members.

7. An adapter according to claim 1 in which the head is substantially rectangular.

8. An adapter according to claim 1 in which the body member has a groove at its lower end for cooperation with a ledge in the stalk of a lamp fitting.

9. An adapter according to claim 1 in which the long sides of the rectangular head are at least twice the length of the short sides.

10. An adapter according to claim 1 in which the electrical contact members extend substantially the whole length of the long sides of the rectangular head.

11. An adapter according to claim 10 in which the electrical contact members include bowed springs.

12. An adapter according to claim 10 in which the electrical contact members are nickel plated.

13. An adapter according to claim 1 in which upstanding members integral with the adapter body are provided which, in use, protrude past the lighting track.

14. An adapter according to claim 13 in which the upstanding members have a knurled surface.

15. A low voltage track lighting system comprising a low voltage lighting track comprising a housing of an insulative material having a top wall and two side walls defining a generally C-shaped channel, each said wall carrying an inwardly directed flange, each side wall supporting a respective supply rail disposed within the channel, and an adapter comprising a body member having a cavity, a substantially rectangular head which, in use, in an end fit within and is displaceable slidably and non-rotationally along the channel the flanges thus supporting the adapter together with any lamp fitting mounted on the adapter, two electrical contact members and a separator of an insulative material, the rectangular head comprising two long sides and two short sides, the long sides being adapted to locate each contact member, a first portion of each member lying within said cavity and a second elongate portion thereof extending outwardly from the head member such that it lies along the long side of the rectangular head the separator being located within said cavity between said first portions to maintain the members in electrical isolation, each said second portion thereof being capable of resiliently contacting a respective supply rail, the dimensions of the head and second portions together relative to those of the channel, and the resilience of the second portions being so as to locate the head within the channel and to establish substantially constant pressure electrical contact between the supply rails and the second portions over a substantial part of the second portions so as to provide electrical power to a lamp fitting supported by the lighting track.

16. A system according to claim 15 in which the electrical contact members include bowed springs.

17. A system according to claim 15 in which the electrical contact members are nickel plated.

18. A system according to claim 15 wherein each electrical contact member has a one-piece construction.

19. A system according to claim 15 in which the separator has a top cover integral with it.

20. An adapter according to claim 15 in which the head is substantially rectangular.

21. A system according to claim 15 in which the body member has a groove at its lower end for cooperation with a ledge in the stalk of a lamp fitting.

22. A system according to claim 15 in which upstanding members integral with the adapter body are provided which, in use, protrude past the lighting track.

23. A system according to claim 22 in which the upstanding members have a knurled surface.

24. A system according to claim 15 in which the head comprises grooves for locating the contact members.

* * * * *